US008854268B2

(12) United States Patent
Lin et al.

(10) Patent No.: US 8,854,268 B2
(45) Date of Patent: Oct. 7, 2014

(54) TUNABLE ANTENNA AND RELATED RADIO-FREQUENCY DEVICE

(75) Inventors: Hsiao-Yi Lin, Hsinchu (TW); Jhih-Yuan Ke, Hsinchu (TW); Chih-Ming Wang, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 220 days.

(21) Appl. No.: 13/561,086

(22) Filed: Jul. 30, 2012

(65) Prior Publication Data

US 2013/0154888 A1 Jun. 20, 2013

(30) Foreign Application Priority Data

Dec. 20, 2011 (TW) ..... 100147446 A

(51) Int. Cl.
*H01Q 1/24* (2006.01)
*H01Q 9/42* (2006.01)

(52) U.S. Cl.
CPC . *H01Q 1/243* (2013.01); *H01Q 9/42* (2013.01)
USPC ..... 343/702; 343/745

(58) Field of Classification Search
CPC ..... H01Q 1/2266; H01Q 9/42; H01Q 9/145; H01Q 5/0058; H01Q 1/243
USPC ..... 343/702, 846, 848, 700 MS, 745
See application file for complete search history.

(56) References Cited

U.S. PATENT DOCUMENTS

| | | | | |
|---|---|---|---|---|
| 6,876,329 | B2 * | 4/2005 | Milosavljevic | 343/700 MS |
| 8,077,116 | B2 * | 12/2011 | Shamblin et al. | 343/895 |
| 2007/0040752 | A1 * | 2/2007 | Sinasi et al. | 343/702 |
| 2007/0069958 | A1 * | 3/2007 | Ozkar | 343/700 MS |
| 2008/0180333 | A1 * | 7/2008 | Martiskainen et al. | 343/722 |
| 2010/0123631 | A1 * | 5/2010 | Chang et al. | 343/700 MS |

* cited by examiner

*Primary Examiner* — Hoanganh Le
(74) *Attorney, Agent, or Firm* — Winston Hsu; Scott Margo

(57) ABSTRACT

A tunable antenna is disclosed. The tunable antenna includes a ground element for providing grounding, a signal feed-in terminal, a radiation unit electrically connected to the signal feed-in terminal and including a long side extended from the signal feed-in terminal along a first direction, a short side extended from the signal feed-in terminal along a second direction, and a branch electrically connected between the signal feed-in terminal and the ground element, a coupling unit for coupling to the long side, and a switch unit for connecting or disconnecting the coupling unit to/from the ground element to change a coupling relationship between the coupling unit and the long side, such that the tunable antenna respectively operates in a first frequency band and a second frequency band.

18 Claims, 16 Drawing Sheets

TUNABLE ANTENNA AND RELATED RADIO-FREQUENCY DEVICE

BACKGROUND OF THE INVENTION

1. Field of the Invention

The present invention relates to a tunable antenna and radio-frequency device, and more particularly, to a tunable antenna and radio-frequency device capable of changing radiation frequencies via connecting or disconnecting a coupling unit with a ground unit of the tunable antenna.

2. Description of the Prior Art

People traveling brings a demand of cross-area wireless service. In general, different telecommunication operators may utilize different wireless communication techniques, even though the wireless communication techniques are the same, operating frequencies may be different indifferent areas. Thus, a demand for a mobile device capable of supporting multiple wireless communication techniques and operating frequencies appears. Taking the Global System for Mobile Communications (GSM) for example, the following Table includes operating frequency ranges of GSM corresponding to different areas:

| Global System for Mobile Communications (GSM) | Frequency Range (MHz) | Area/Country |
|---|---|---|
| 800 | 824-894 | USA |
| 1900 | 1850-1990 | |
| 900 | 880-960 | Europe |
| 1800 | 1710-1880 | |

Wireless communication devices are trending toward light weight and low profile, it is hence insufficient in antenna bandwidth. However, the lower frequency operation, the larger the antenna size is required for effective radiation.

Therefore, how to achieve multiple operating frequencies within a limited antenna dimension has become a goal in the wireless communication industry.

SUMMARY OF THE INVENTION

It is therefore an object of the present invention to provide a tunable antenna and radio-frequency device capable of changing radiation frequencies via switching a coupling unit to connect with a ground unit of the tunable antenna.

The present invention discloses a tunable antenna comprising a ground element for providing grounding, a signal feed-in terminal, a radiation unit electrically connected to the signal feed-in terminal and including a long side extended from the signal feed-in terminal along a first direction, a short side extended from the signal feed-in terminal along a second direction, and a branch electrically connected between the signal feed-in terminal and the ground element, a coupling unit for coupling to the long side, and a switch unit for connecting or disconnecting the coupling unit to the ground element to change a coupling relationship between the coupling unit and the long side, such that the tunable antenna respectively operates in a first frequency band and a second frequency band.

The present invention further discloses a radio-frequency (RF) device for a wireless communication device, the RF device comprising a tunable antenna comprising a ground element for providing grounding, a signal feed-in terminal, a radiation unit electrically connected to the signal feed-in terminal and including a long side extended from the signal feed-in terminal toward a first direction, a short side extended from the signal feed-in terminal toward a second direction and a branch electrically connected between the signal feed-in terminal and the ground element, a coupling unit for coupling the long side, and a switch unit for connecting or disconnecting the coupling unit and the ground element to change a coupling relationship between the coupling unit and the long side, an RF signal process module for processing an RF signal transmitted and received by the tunable antenna, and outputting a control signal according to the RF signal, and a control unit coupled between the RF signal process module and the switch unit for controlling the switch unit to adjust a connection between the coupling unit and the ground element according to the control signal, such that the tunable antenna respectively operates in a first frequency band and a second frequency band.

The present invention further discloses a tunable antenna comprising a ground element for providing grounding, a signal feed-in terminal, a coupling unit electrically connected to the signal feed-in terminal for feeding the tunable antenna through coupling, a radiation unit comprising a long side extended along a first direction, and at least one short side electrically connected to the long side and extended along a second direction, and a switch unit for switching one of the at least one short side to connect with the ground element to change a coupling current route on the radiation unit, such that the tunable antenna respectively operates in a first frequency band and a second frequency band.

The present invention further discloses a radio-frequency (RF) device for a wireless communication device, the RF device comprising a tunable antenna comprising a ground element for providing grounding, a signal feed-in terminal, a coupling unit electrically connected to the signal feed-in terminal for feeding the tunable antenna through coupling, a radiation unit comprising a long side extended along a first direction, and at least one short side electrically connected to the long side and extended along a second direction, and a switch unit for switching one of the at least one short side to connect with the ground element to change a coupling current route on the radiation unit, an RF signal process module for processing an RF signal transmitted and received by the tunable antenna, and outputting a control signal according to the RF signal, and a control unit coupled between the RF signal process module and the switch unit for controlling the switch unit according to the control signal to adjust a coupling current route on the radiation unit, such that the tunable antenna respectively operates in a first frequency band and a second frequency band.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
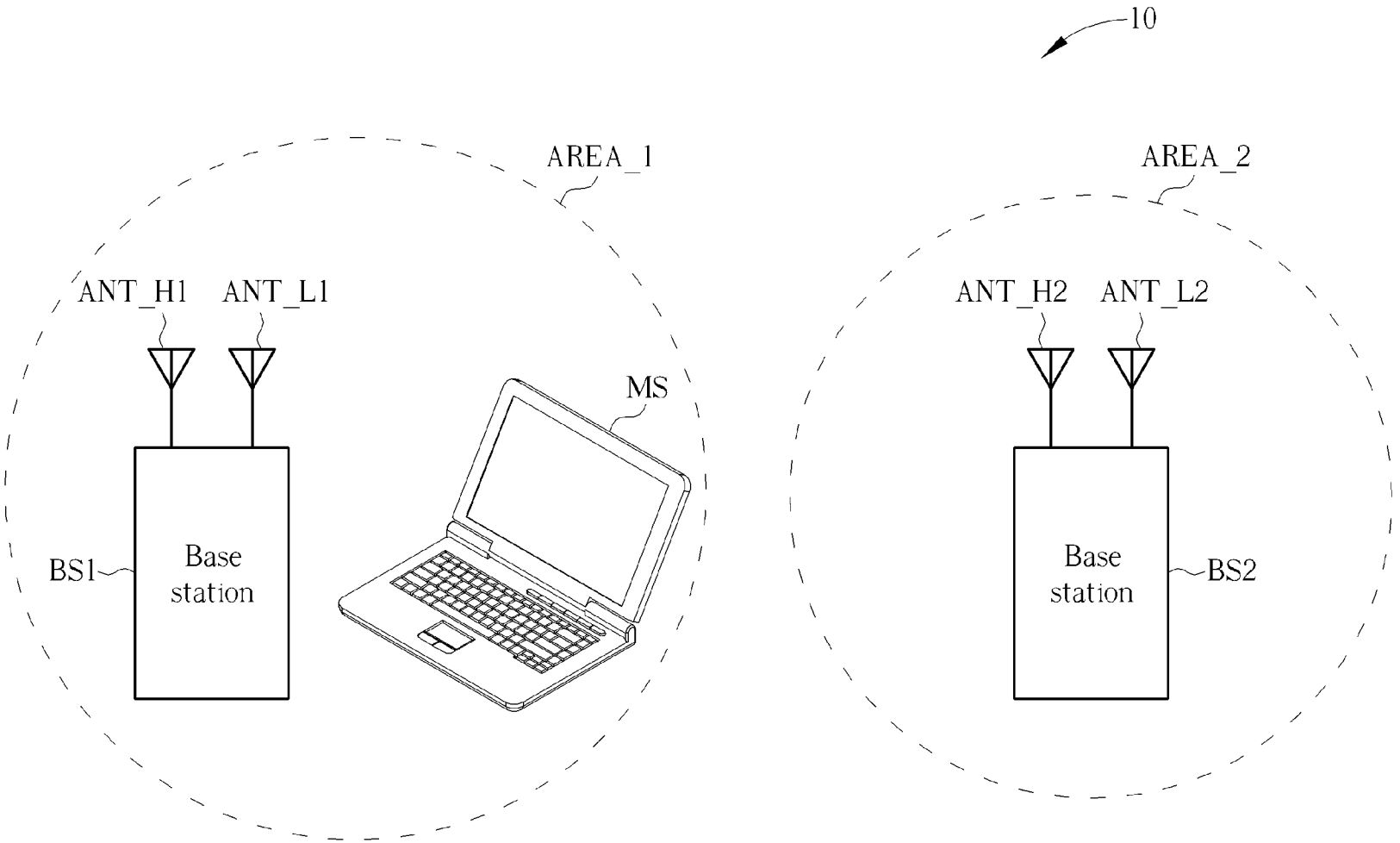
FIG. 1 is a schematic diagram of a wireless communication environment according to an embodiment of the present invention.

Please refer to FIG. 1, which is a schematic diagram of a wireless communication environment 10 according to an embodiment of the present invention. The wireless communication environment 10 covers different operating bands across different countries/areas. The wireless communication environment 10 comprises base stations BS1 and BS2 and a mobile station MS. The base stations BS1, BS2 are located in different areas, utilize different operating bands and have signal coverage AREA_1 and AREA_2, respectively. For example, the base station BS1 operates in United States and includes antennas ANT_L1 and ANT_H1 respectively for operating in a low frequency band (800 MHz) and a high frequency band (1900 MHz). The base station BS2 operates in Europe and includes antennas ANT_L2 and ANT_H2 respectively for operating in a low frequency band (900 MHz) and a high frequency band (1800 MHz). The mobile station MS may be an electronic product with a function of wireless communications, such as a mobile phone, a computer system, a wireless access point and so on.

The mobile station MS has a frequency bandwidth to cover 1800 MHz and 1900 MHz frequency bands, and the mobile station MS utilizes a built-in radio-frequency (RF) device to switch one of 800 MHz and 900 MHz frequency bands, such that the mobile station MS is capable of communicating with the base stations BS1 and BS2. Specifically, as shown in FIG. 1, when the wireless communication function of the mobile station MS is turned on, the mobile station MS searches surrounding base stations by scanning wireless signals within high frequency bands. For example, the mobile station MS may determine itself as in the signal coverage AREA_1 of the base station BS1 once the wireless signals in 1900 MHz transmitted by the antenna ANT_H1 of the base station BS1 are received. Therefore, the mobile station MS may control the RF device to switch to the low frequency band to 800 MHz to receive the wireless signals transmitted by the antenna ANT_L1. Similarly, the mobile station MS may determine itself to be in the signal coverage AREA_2 of the base station BS2 once the wireless signals in 1800 MHz transmitted by the antenna ANT_H2 of the base station BS2 are received. Therefore, the mobile station MS may control the RF device to switch to the low frequency band to 900 MHz to receive the wireless signals transmitted by the antenna ANT_L2. The traditional wireless communication device has a limited bandwidth to include 800 MHz and 900 MHz bands at the same time, which causes the traditional wireless communication device to be only able to link to one of the base stations BS1, BS2. In comparison, the mobile station MS of the present invention may search for the local base station through the wireless signals in high frequency bands to automatically identify where it is located, and accordingly switch to the appropriate low frequency band. As a result, the mobile station MS may operate across different areas.

Figure 2:
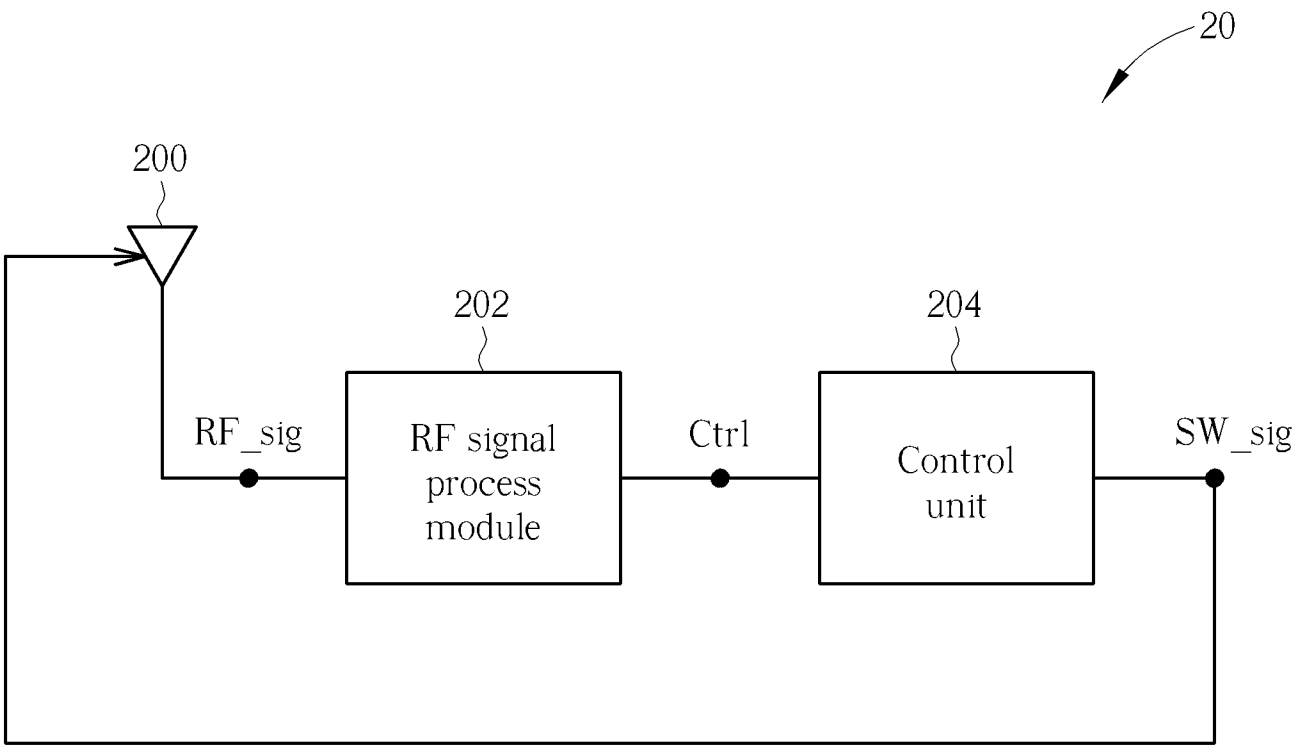
FIG. 2 is a schematic diagram of a wireless communication device according to an embodiment of the present invention.

Please refer to FIG. 2, which is a schematic diagram of an RF device 20 according to an embodiment of the present invention. The RF device 20 includes a tunable antenna 200, an RF signal process module 202 and a control unit 204. The RF signal process module 202 is used for processing an RF signal RF_sig transmitted and received by the tunable antenna 200, and the RF signal process module 202 may determine in which area the RF signal RF_sig is transmitted by the base station according to a carrier frequency F_ca (not shown in FIG. 2) of the RF signal RF_sig, so as to output a control signal ctrl to the control unit 204. The control unit 204 is used for outputting a switch signal SW_sig according to the control signal ctrl to adjust the low frequency band of the tunable antenna 200. In other words, the RF device 20 may automatically determine in which of the signal coverages of the base stations BS1, BS2 that the mobile station MS is located according to the RF signal RF_sig received by the tunable antenna 200, such that a radiation frequencies in the low frequency band of the tunable antenna 200 is switched to adapt to the operating frequency of the local base station.

The present invention provides the tunable antenna with two different types corresponding to different methods of feeding the RF signal to the tunable antenna, and adjusts a current route or a coupling effect of the tunable antenna, respectively. The following description is separated into 2 parts to illustrate the antenna design of the present invention.

The first type of the tunable antenna is directly feed the RF signal into a radiator of the tunable antenna and the low frequency band is changed by switching a coupling effect of the tunable antenna. Please refer to FIG. 3, which is a schematic diagram of a tunable antenna 30 according to an embodiment of the present invention. The tunable antenna 30 includes a ground element 300, a signal feed-in terminal 302, a radiation unit 304, a coupling unit 306 and a switch unit 308. The signal feed-in terminal 302 is electrically connected to the radiation unit 304 for feeding an RF signal to the radiation unit 304, so that the radiation unit 304 may transmit and receive the RF signal accordingly. The switch unit 308 may be any kind of switch, such as a Bipolar Junction Transistor (BJT) or a Metal Oxide Semiconductor Field Effect Transistor (MOSFET), as long as the switch unit 308 is capable of receiving a switch signal SW_sig from the control unit 204 to switch the coupling unit 306.

Figure 3:
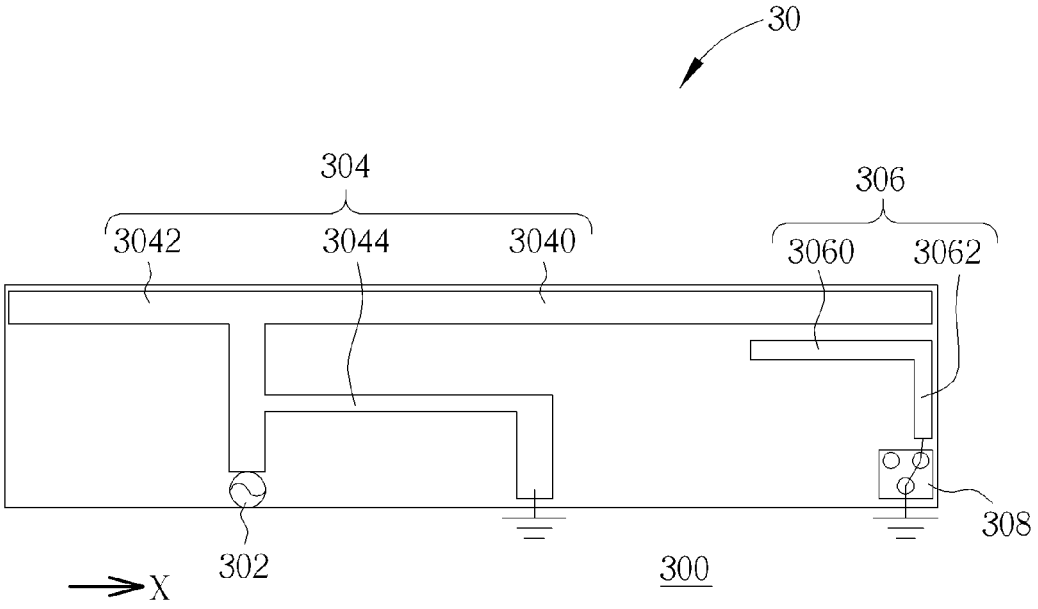
FIG. 3 is a schematic diagram of a tunable antenna according to an embodiment of the present invention.

As shown in FIG. 3, the radiation unit 304 includes a long side 3040, a short side 3042 and a branch 3044. The long side 3040 is extended from the signal feed-in terminal 302 along a direction X. The short side 3042 is extended from the signal feed-in terminal 302 along a direction opposite to the direction X. The branch 3044 is electrically connected to the ground element 300 along the direction X. Wireless signals within lower frequencies require a longer current route to be radiated to the air; while wireless signals within higher frequencies require a shorter current route to be radiated to the air. Thus, the tunable antenna 30 has a structure to generate two current routes to transmit and receive the wireless signal corresponding to different radiation frequencies, wherein the long side 3040 is used for transmitting and receiving the wireless signals within lower frequency band, and the short side 3042 is used for transmitting and receiving the wireless signals within higher frequency band. The branch 3044 is connected to the ground such that a return current on the tunable antenna 30 is returned to the ground element 300 through the branch 3044 instead of other conductive elements, which ensures a stable radiation performance of the tunable antenna 30. Therefore, the branch 3044 may enhance the radiation performance of the tunable antenna 30 against an influence of the environment. The coupling unit 306 is disposed close to an end of the long side 3040 to be connected to or disconnected from the ground element 300 by the switch unit 308, such that a coupling effect between the coupling unit 306 and the long side 3040 may be changed to change an effective capacitance between the long side 3040 and the ground element 300. Specifically, when the switch unit 308 connects the coupling unit 306 from the ground element 300, an effective capacitance between the long side 3040 and the ground element 300 may be increased through the coupling unit 306, and thus the radiation frequencies of the tunable antenna 30 is shifted to a lower frequency band. When the switch unit 308 disconnects the coupling unit 306 and ground element 300, the lower radiation frequencies of the tunable antenna 30 may be shifted back to the original frequency band.

In short, the radiation frequencies of the tunable antenna 30 are changed by changing the coupling effect between the long side 3040 and the coupling unit 306 via the switch unit 308 connecting or disconnecting the coupling unit 306 to/from the ground element 300. As a result, the tunable antenna 30 may properly adjust the radiation frequencies corresponding to different frequency bands to meet practical requirement.

Figure 4A:
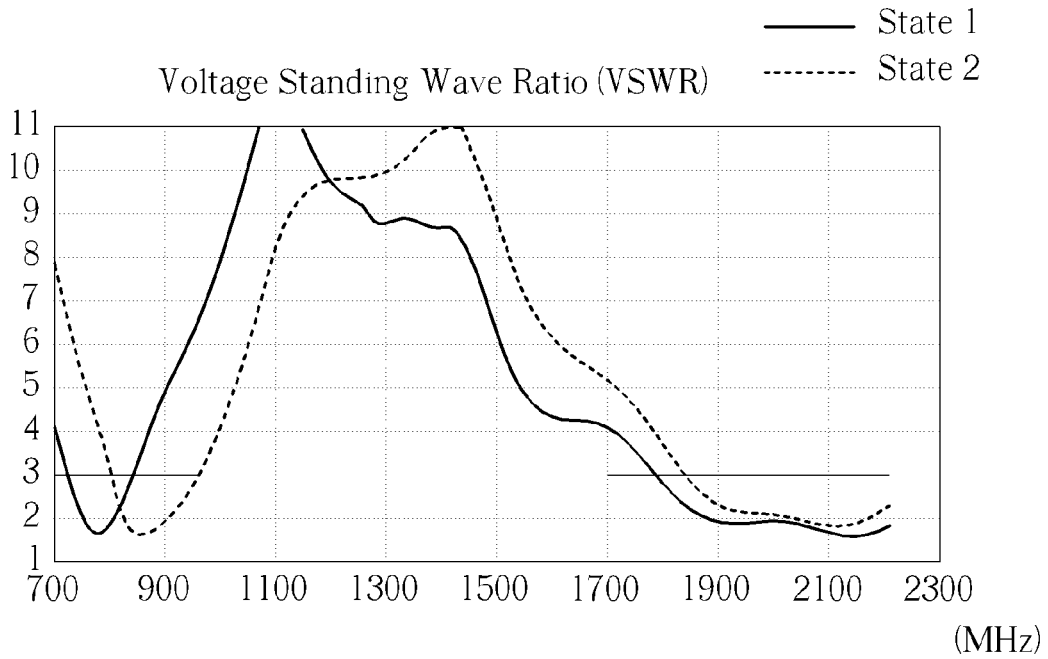
FIG. 4A is a VSWR diagram of the tunable antenna shown in FIG. 3 corresponding to different switch states.
Figure 4B:
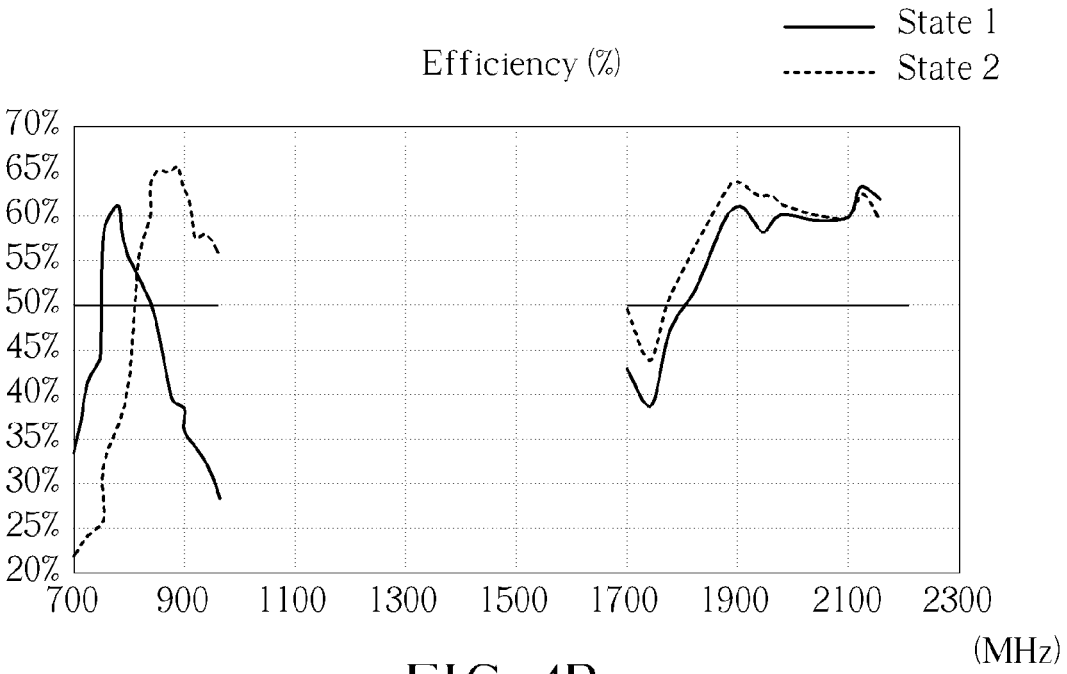
FIG. 4B is a radiation efficiency diagram of the tunable antenna shown in FIG. 3 corresponding to different switch states.

The following description illustrates an antenna performance of the tunable antenna 30 corresponding to different switch states. Please refer to FIG. 4A and FIG. 4B, which are schematic diagrams of a Voltage Standing Wave Ratio (VSWR) and a radiation efficiency of the tunable antenna 30, respectively. State 1 and state 2 respectively represent that the switch unit 308 connects and disconnects the coupling unit 306 to the ground element 300. As shown in FIG. 4A, at state 1, which is denoted with a solid line, the minimum VSWR in the lower frequency band of the tunable antenna 30 lies around 800 MHz, and the VSWR less than 3 is around 730~830 MHz. In comparison, at state 2, which is denoted with a dotted line, the minimum VSWR in the lower frequency band of the tunable antenna 30 is shifted from around 800 MHz to 900 MHz, and the VSWR less than 3 is around 800~960 MHz. As can be seen, an amount of the frequency shift of the tunable antenna 30 is around 100 MHz switching between states 1, 2, and the frequency bandwidth of the well-matched VSWR meets the requirement of 800 MHz and 900 MHz frequency bands. As shown in FIG. 4B, the highest radiation efficiencies corresponding to the state 1 and the state 2 respectively lie in the center of the 800 MHz and 900 MHz frequency bands. The bandwidth in which the radiation efficiencies are greater than 50% meets the requirement of the 800 MHz and 900 MHz frequency bands as well.

Therefore, as can be seen from FIG. 4A and FIG. 4B, the 800 MHz and 900 MHz radiation frequency bands of the tunable antenna 30 may be switched by the switch unit 308 to ensure antenna performance within a limited antenna space. Noticeably, the present invention may adjust the connection between the coupling unit 306 and the ground element 300 to change the radiation frequencies in the lower frequency bands, i.e. 800 MHz and 900 MHz. Those skilled in the art may make modifications or alterations accordingly. For example, the tunable antenna 30 may be made of a bent metal sheet and contain a dielectric material to fix its antenna body. Preferably, the tunable antenna 30 may be a printed antenna, which is formed on a substrate made of an FR4 glass fiber, and the substrate may be made of single side, double sides or multiple layers. For a double sides printed tunable antenna 30, the radiation unit 304 and the coupling unit 306 may be printed on different sides of the substrate, such that part of the coupling unit 306 may overlap with the long side 3040 of the radiation unit 304, which provides various coupling effects between the coupling unit 306 and the long side 3040 to broaden a design flexibility of the tunable antenna 30.

In FIG. 3, the coupling unit 306 includes a horizontal side 3060 and a vertical side 3062, the horizontal side 3060 is substantially parallel to the long side 3040, a distance between the horizontal side 3060 and the long side 3040 is preferably but not limited to be less than a quarter of a total length of the coupling unit 306. An angle between the horizontal side 3060 and the long side 3040 may be properly adjusted. The horizontal side 3060 may partially overlap with the long side 3040 of the double sides printed tunable antenna 30 to have various coupling effects between the horizontal side 3060 and the long side 3040, such that different amounts of frequency shift may be generated on the tunable antenna 30.

Figure 5A:
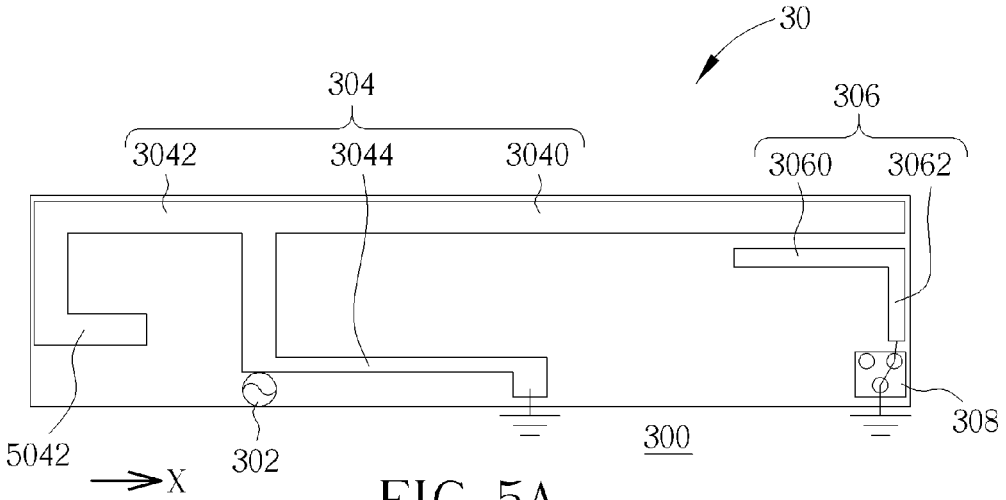
FIG. 5A to FIG. 5E are schematic diagrams of another tunable antennas according to embodiments of the present invention.
Figure 5B:
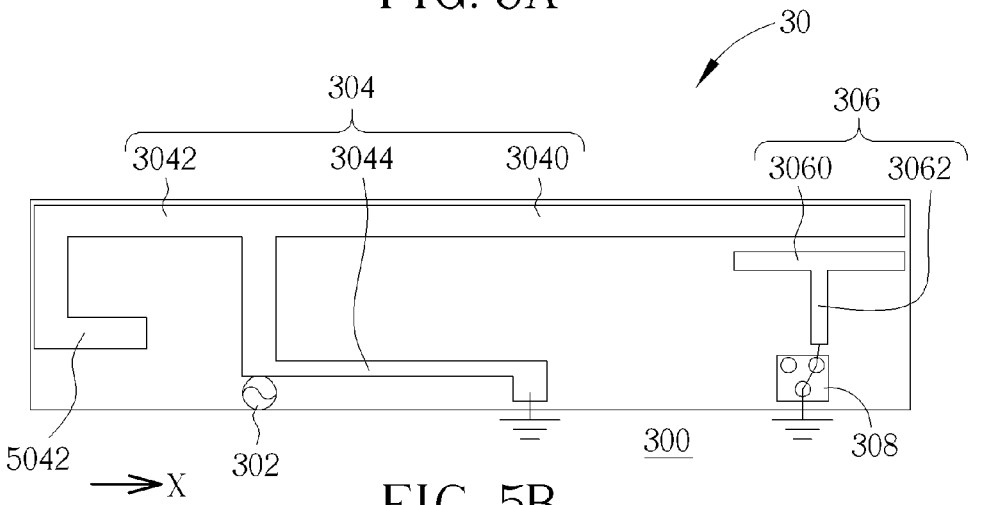
Figure 5C:
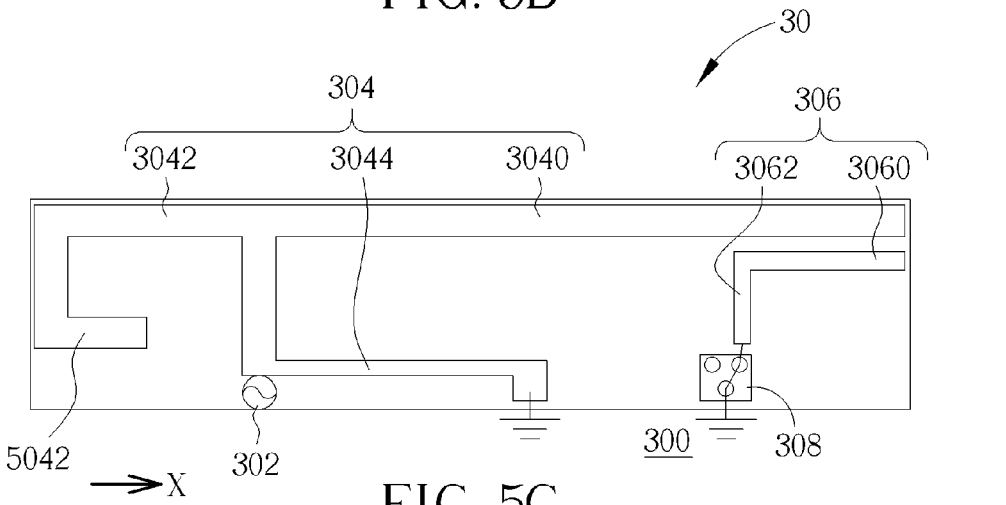
Figure 5D:
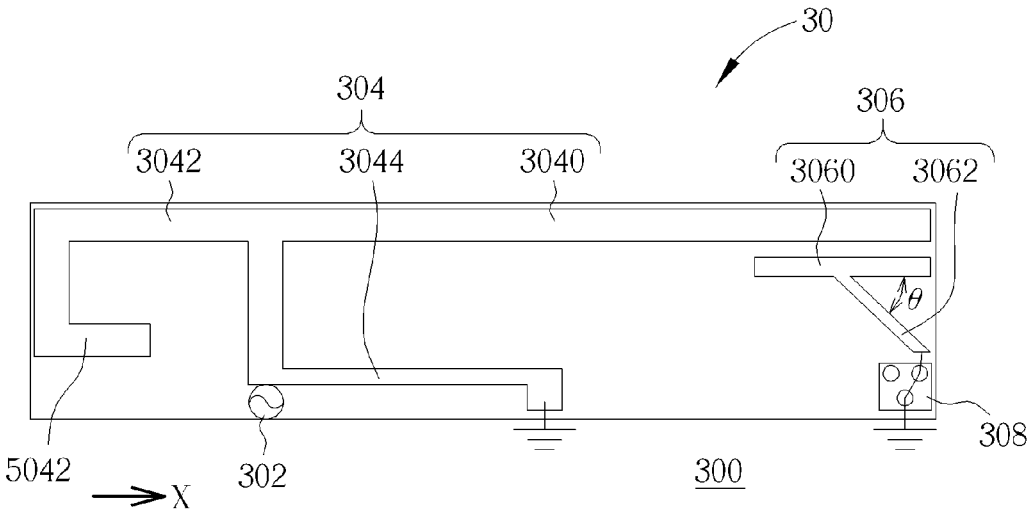
Figure 5E:
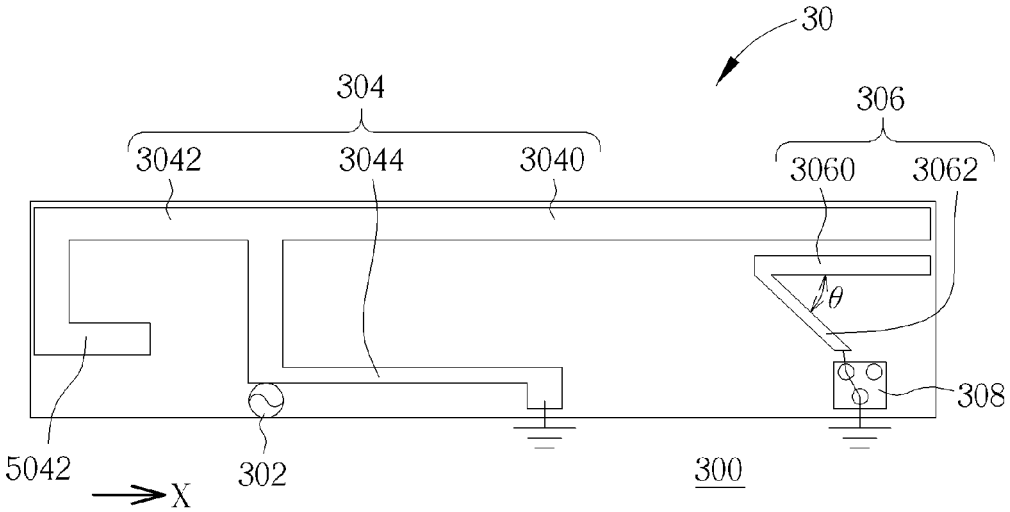

In addition, shapes of the coupling unit 306 and the radiation unit 304 are not limited. For example, please refer to FIG. 5A to FIG. 5E, which are schematic diagrams of the coupling unit 306 and the radiation unit 304 having different shapes. Since structures of FIG. 5A to FIG. 5E are similar to the structure of FIG. 3, same elements are denoted with the same symbols. In FIG. 5A to FIG. 5E, the short side 3042 further includes a bend 5042 for changing frequencies within the high radiation frequency bands. As shown in FIG. 5A to FIG. 5C, a position that the vertical side 3062 is electrically connected to the horizontal side 3060 may be moved, as long as a position of the switch unit 308 is moved accordingly. FIG. 5D and FIG. 5E illustrate that the vertical side 3062 is not limited to being perpendicular to the horizontal side 3060, the vertical side 3062 may be connected to the horizontal side 3060 with an angle θ. Further more, shapes of the horizontal side 3060 and the vertical side 3602 is not limited to a bar; a meandering shape is feasible as well. As a result, the tunable antenna 30 may have various combinations of coupling relationships and antenna design flexibility.

Figure 6A:
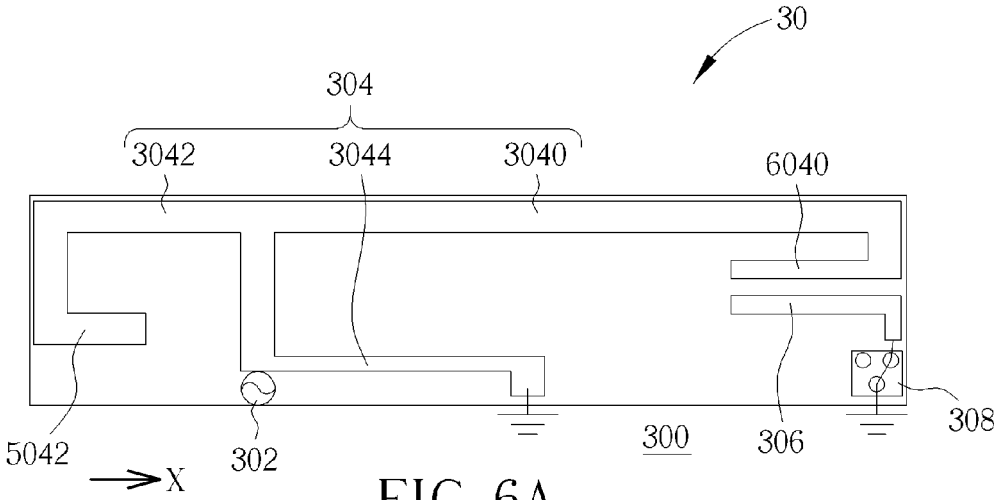
FIG. 6A to FIG. 6C are schematic diagrams of another tunable antennas according to embodiments of the present invention.
Figure 6B:
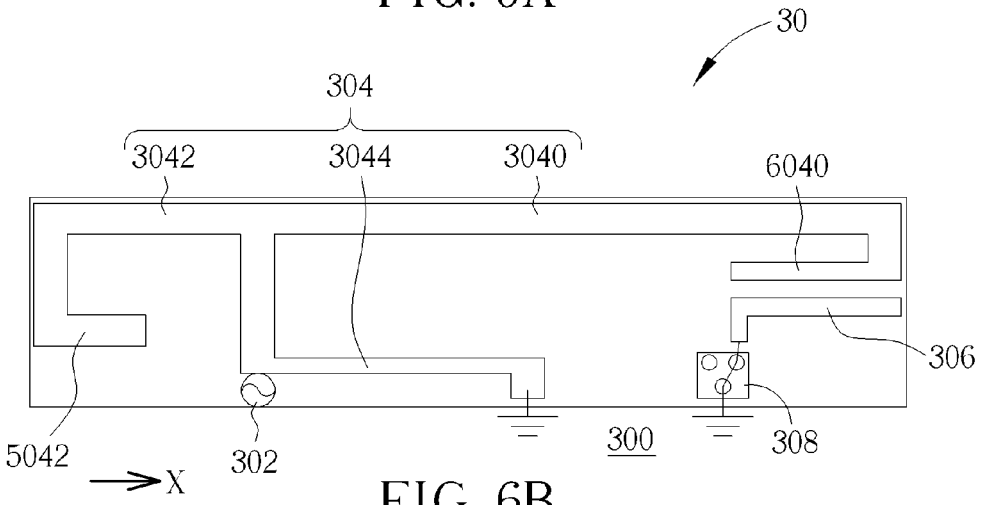
Figure 6C:
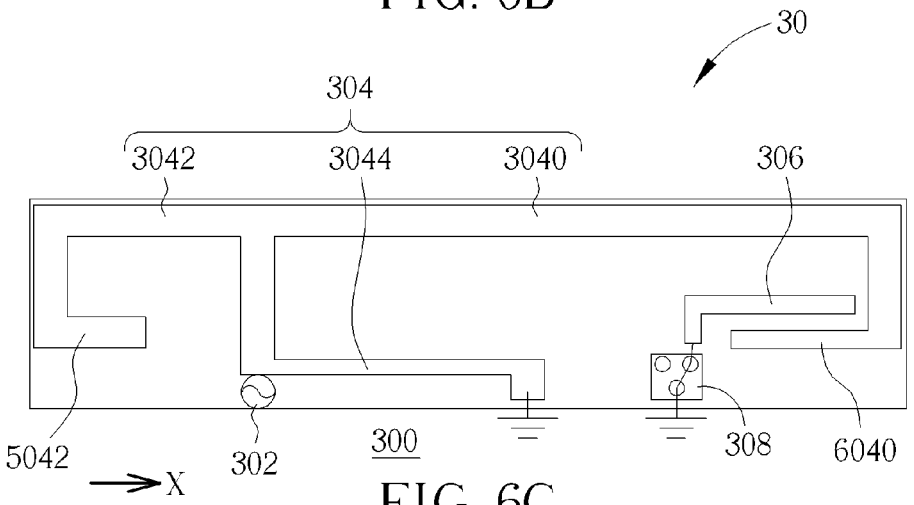

On the other hand, besides the short side 3042 including the bend 5042, the long side 3040 may include a bend 6040 as well, such that the frequencies within the high or low radiation frequency bands may be adjusted according to practical requirements. Please refer to FIG. 6A to FIG. 6C, which are schematic diagrams of relative positions between the bend 6040 and the coupling unit 306. The vertical side 3062 is electrically connected to a left or right end of the horizontal side 3060, which is shown in FIG. 6A and FIG. 6B, respectively. A difference between FIG. 6B and FIG. 6C is that the coupling unit 306 in FIG. 6C locates between the bend 6040 and the long side 3040, wherein the bend 6040 is closer to the ground element 300 to lengthen a current route on the long side 3040 and increase an effective capacitance between the long side 3040 and the ground element 300. As a result, the tunable antenna 30 may have various antenna designs.

Figure 7A:
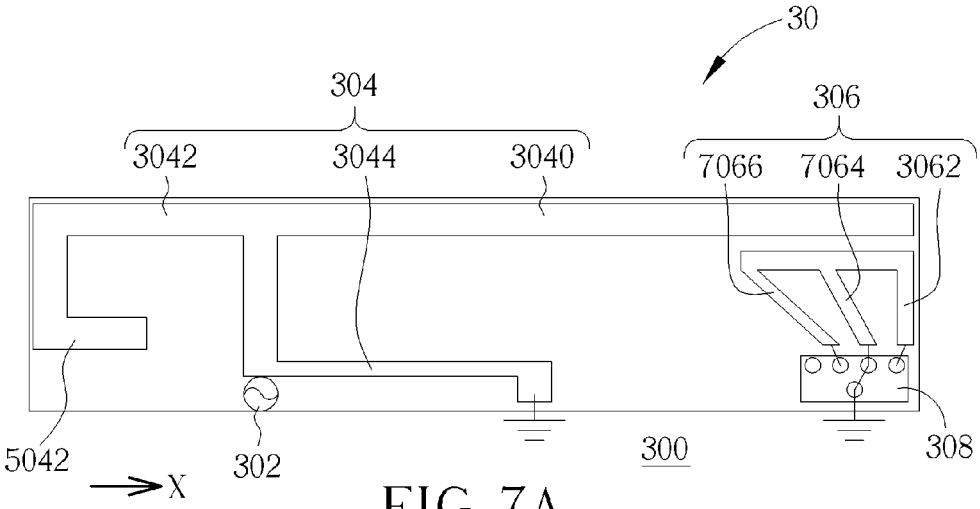
FIG. 7A to 7C are schematic diagrams of another tunable antennas according to embodiments of the present invention.
Figure 7B:
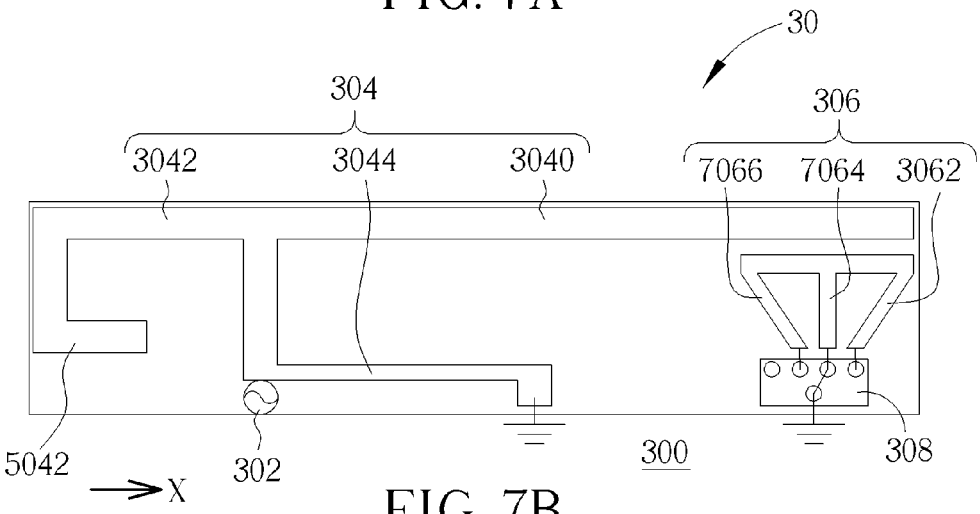
Figure 7C:
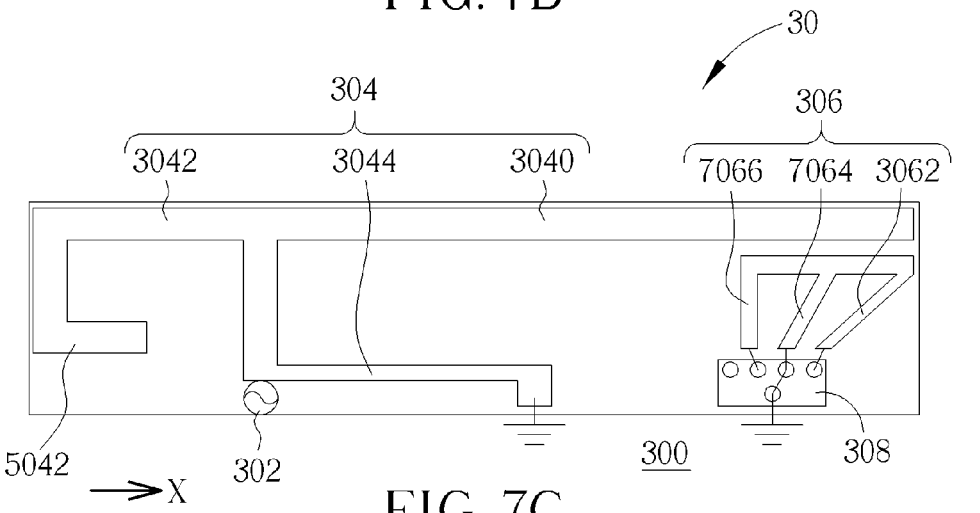

Please note that the present invention changes the radiation frequencies of the tunable antenna 30 via connecting or disconnecting the coupling unit 306 to/from the ground element 300. Besides the switch state 1 or state 2, the present invention may further switch multiple states to have different amounts of frequency shift within a single antenna. Please refer to FIG. 7A to FIG. 7C, which are schematic diagrams of three switch states according to an embodiment of the present invention. As shown in FIG. 7A, the coupling unit 306 further includes vertical sides 7064 and 7066, such that the switch unit 308 may switch one of the vertical sides 3062, 7064 and 7066 to connect with the ground element 300 to have the desired amount of frequency shift. In other words, multiple coupling effects between the coupling unit 306 and the long side 3040 may be generated via increasing a number of the vertical sides to provide multiple switch states. FIG. 7B and FIG. 7C illustrate different positions of the vertical sides 3062, 7064 and 7066 and the switch unit 308. Therefore, the tunable antenna 30 in FIG. 7A has four switch states, three of which are respectively connecting the vertical sides 3062, 7064 and 7066 with the ground element 300, and the other state is the vertical sides 3062, 7064 and 7066 are all disconnected.

As a result, the present invention may have different amounts of frequency shift via designing different coupling units, such as increasing a number of the vertical sides, changing the shape of the coupling unit, moving a position of the coupling unit relative to the radiation unit and so on, such that the tunable antenna may be switched between the required frequency bands to effectively cover all the required frequency bands within a limited antenna space.

The second type of the tunable antenna is to feed the RF signal into a coupling unit and the low frequency band is switched by changing a length of current route on a radiator of the tunable antenna. Please refer to FIG. 8, which is a schematic diagram of a tunable antenna 80 according to an embodiment of the present invention. The tunable antenna 80 includes a ground element 800, a signal feed-in terminal 802, a radiation unit 804, a coupling unit 806 and a switch unit 808. The coupling unit 806 is disposed close to an end of the long side 8040 and electrically connected to the signal feed-in terminal 802 to feed in an RF signal. The RF signal is transmitted to the radiation unit 804 through the coupling unit 806 by a coupling effect to be transmitted to the air.

Figure 8:
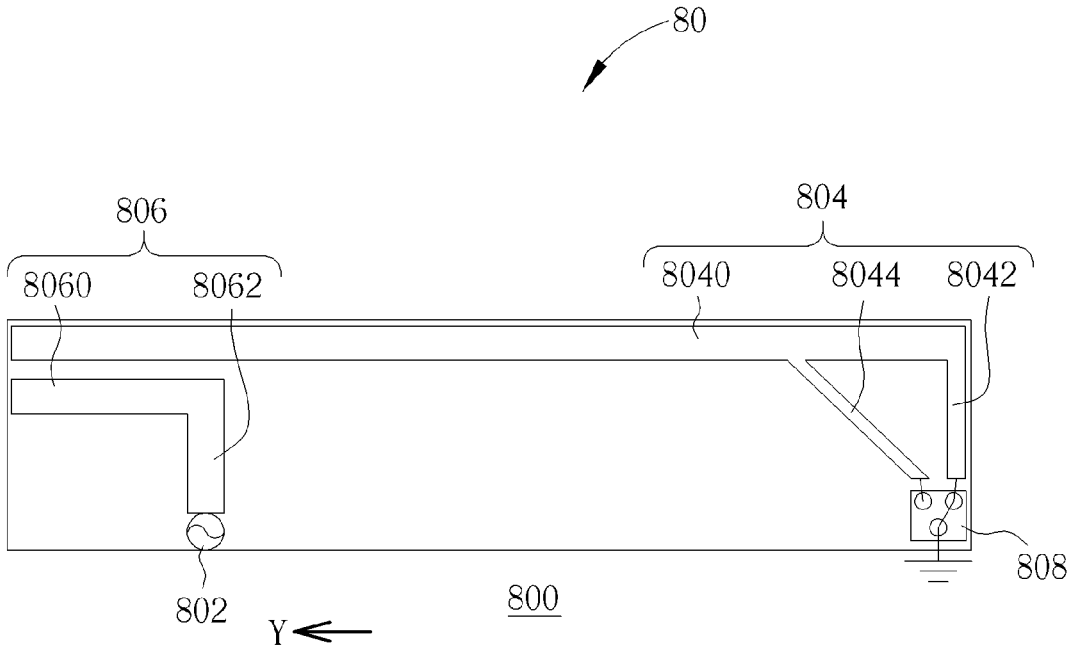
FIG. 8 is a schematic diagram of a tunable antenna according to an embodiment of the present invention.

As shown in FIG. 8, the radiation unit 804 includes a long side 8040 and short sides 8042, 8044. The long side 8040 is extended from the short side 8042 along a direction Y. The short sides 8042, 8044 are electrically connected to distinct positions of the long side 8040. By the switch unit 808 respectively connecting the short sides 8042, 8044 to the ground element 800, different current routes on the radiation unit 804 may be generated, such that radiation frequencies of the tunable antenna 80 may be shifted accordingly. In such a structure, there may be two different current routes generated on the tunable antenna 80 to transmit and receive the RF signal corresponding to two frequency bands. When the switch unit 808 connects the short side 8042 with the ground element 800, a longer current route on the radiation unit 804 is generated, such that the radiation frequencies in the low frequency band of the tunable antenna 80 may be shifted to a lower frequency band (824-894 MHz). On the other hand, when the switch unit 808 connects the short side 8044 with the ground element 800, a shorter current route on the radiation unit 804 is generated, such that the radiation frequencies of the tunable antenna 80 may be shifted back to the original frequency band (880-960 MHz).

In short, the tunable antenna 80 may change the length of the current route on the radiation unit 804 by the switch unit 808 to connect or disconnect one of the short sides 8042, 8044 with the ground element 800, such that the radiation frequencies in the low frequency bands may be adjusted accordingly.

Figure 9A:
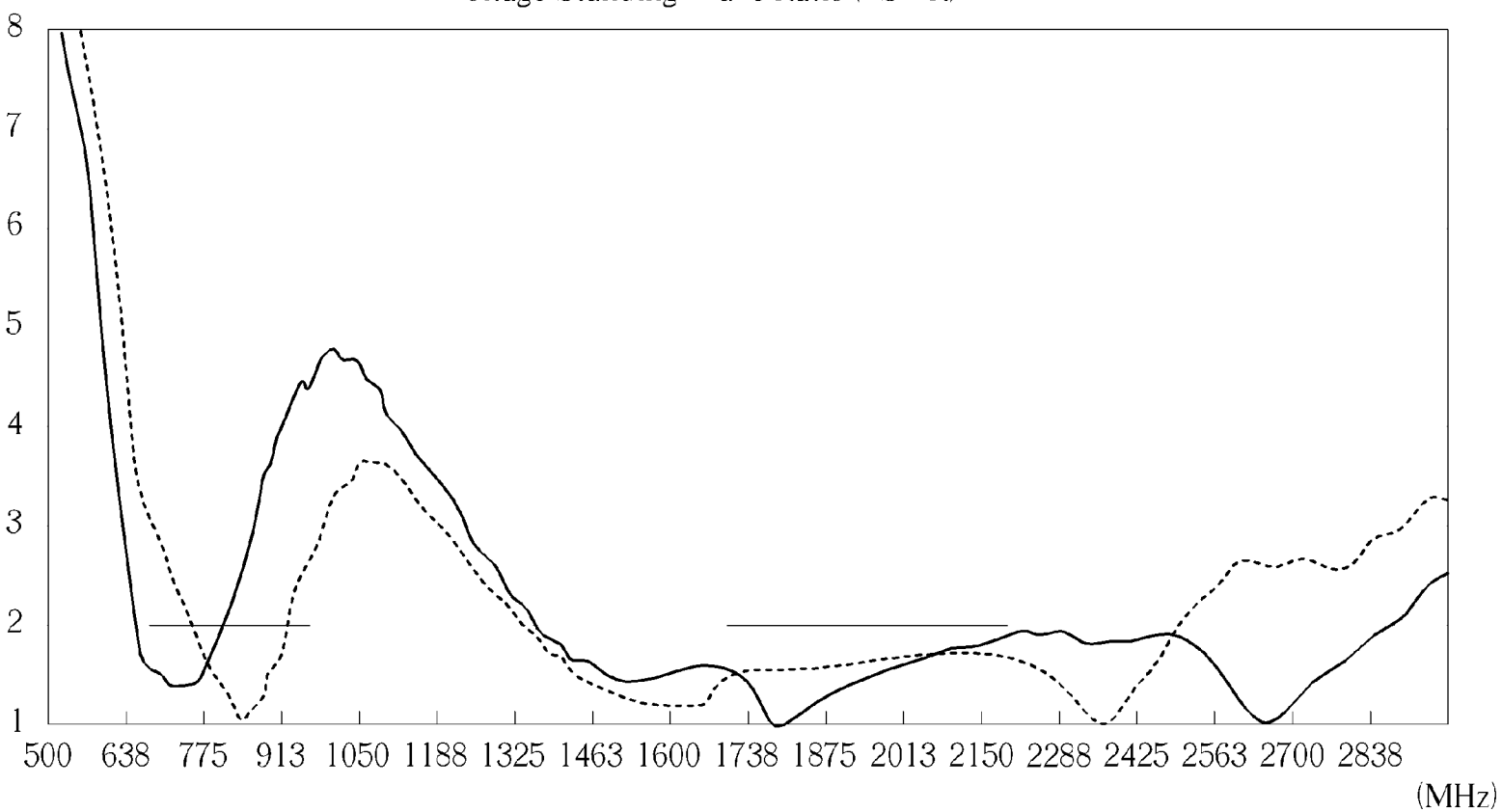
FIG. 9A is a VSWR diagram of the tunable antenna shown in FIG. 8 corresponding to different switch states.
Figure 9B:
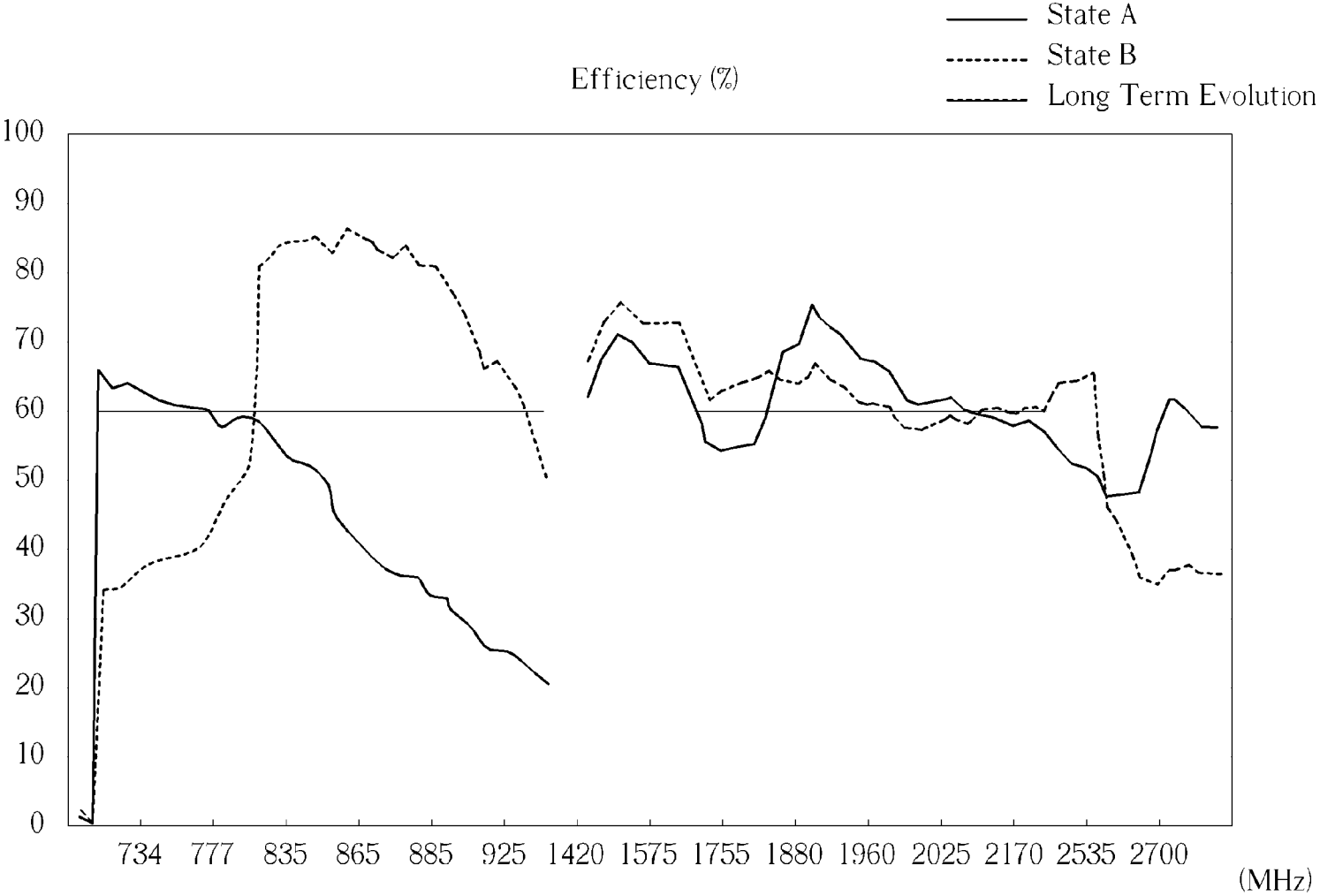
FIG. 9B is a radiation efficiency diagram of the tunable antenna shown in FIG. 8 corresponding to different switch states.

The following description illustrates an antenna performance of the tunable antenna 80 corresponding to different switch states. Please refer to FIG. 9A and FIG. 9B, which are schematic diagrams of a VSWR and a radiation efficiency of the tunable antenna 80, respectively. State A and state B respectively represent that the switch unit 808 connects one of the short sides 8042 or 8044 to the ground element 800. As shown in FIG. 9A, in state A, which is denoted with a solid line, the minimum VSWR in the lower frequency band of the tunable antenna 80 lies around 740 MHz, and the VSWR less than 2 is around 640~780 MHz. In comparison, in state B, which is denoted with a dotted line, the minimum VSWR in the lower frequency band of the tunable antenna 80 is shifted to around 900 MHz, and the VSWR less than 2 is around 750~920 MHz. As a result, an amount of total frequency bandwidth of the states A, B may meet one of the frequency requirements of the LTE (Long Term Evolution) system, i.e. 700 MHz band (704-745 MHz), such that the tunable antenna 80 may support multiple wireless communication techniques. Moreover, an amount of the frequency shift of the tunable antenna 80 is around 160 MHz switching between the states A, B, and the frequency bandwidth of the well-matched VSWR meets the requirements of 700 MHz and 800 MHz frequency bands. As shown in FIG. 9B, the highest radiation efficiencies corresponding to state A and state B respectively lie in the center of the 750 MHz and 850 MHz frequency bands. The bandwidth in which the radiation efficiencies are greater than 50% meets the requirement of the 700 MHz and 800 MHz frequency bands as well.

Therefore, as can be seen from FIG. 9A and FIG. 9B, the radiation frequencies within the low frequency band of the tunable antenna 80 may be changed by the switch unit 808 to effectively cover the requirement of multiple frequency bands within a limited antenna space. Those skilled in the art may make modifications or alterations accordingly. For example, the tunable antenna 80 may be made of a bent metal and combined with a dielectric material to fix the antenna body. Preferably, the tunable antenna 80 may be a single side, double sides or multi-layer printed antenna, which is printed on an FR-4 substrate. Take the double sides printed tunable antenna 80 as an example, the radiation unit 804 and the coupling unit 806 may be respectively printed on a top and bottom side of the FR-4 substrate, such that the coupling unit 806 and the radiation unit 804 may be partially overlapped, which may increase a variability of the coupling effect between the coupling unit 806 and the radiation unit 804 to increase the design flexibility of the tunable antenna 80.

In FIG. 8, the coupling unit 806 includes a horizontal side 8060 and a vertical side 8062, wherein the horizontal side 8060 is substantially parallel to the long side 8040. Besides, an angle between the horizontal side 8060 and the long side 8040 may be properly adjusted. A distance between the horizontal side 8060 and the long side 8040 is not limited; part of the horizontal side 8060 may overlap the long side 8040 via a double sides printed tunable antenna 80 to have different coupling effects between the horizontal side 8060 and the long side 8040 such that different levels of frequency shift may be generated on the tunable antenna 80.

Figure 10A:
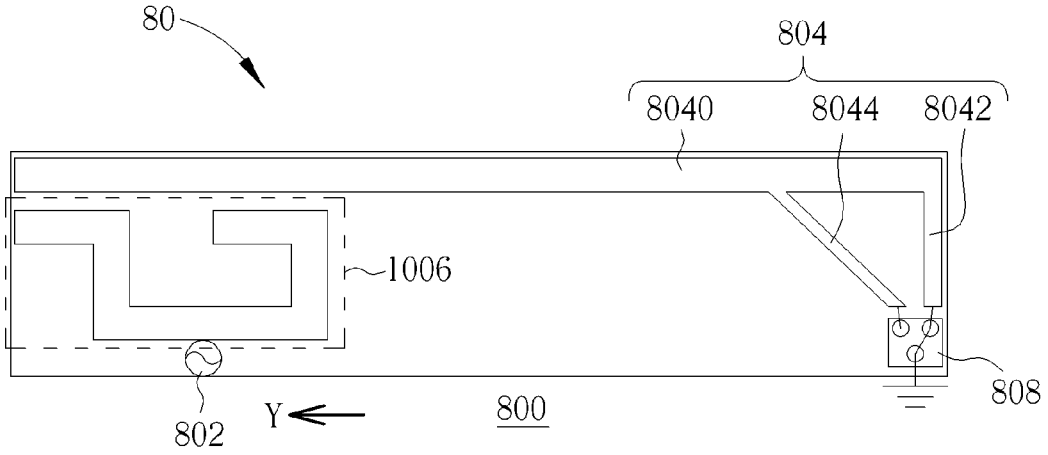
FIG. 10A to FIG. 10E are schematic diagrams of another tunable antennas according to embodiments of the present invention.
Figure 10B:
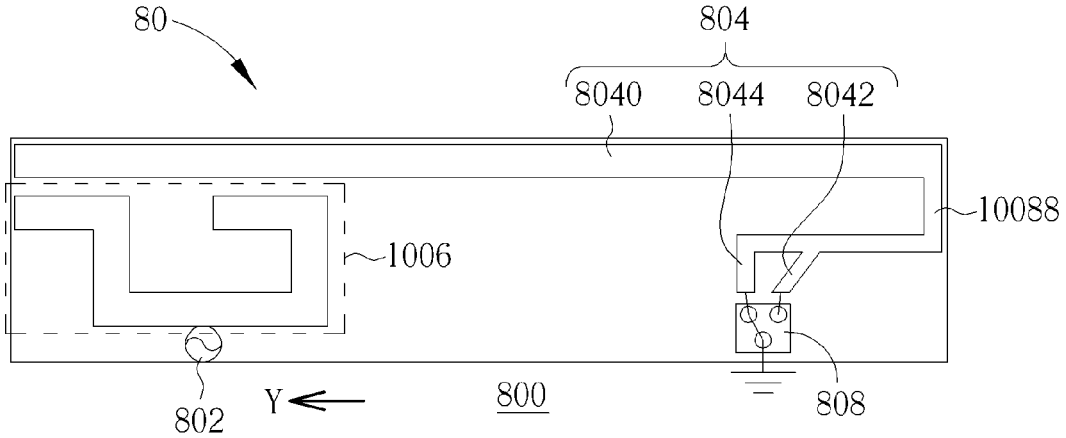
Figure 10C:
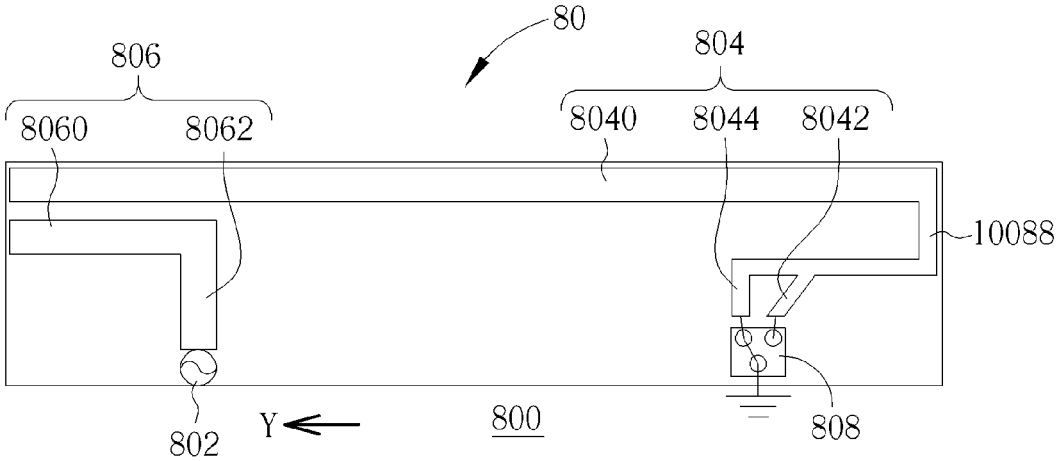
Figure 10D:
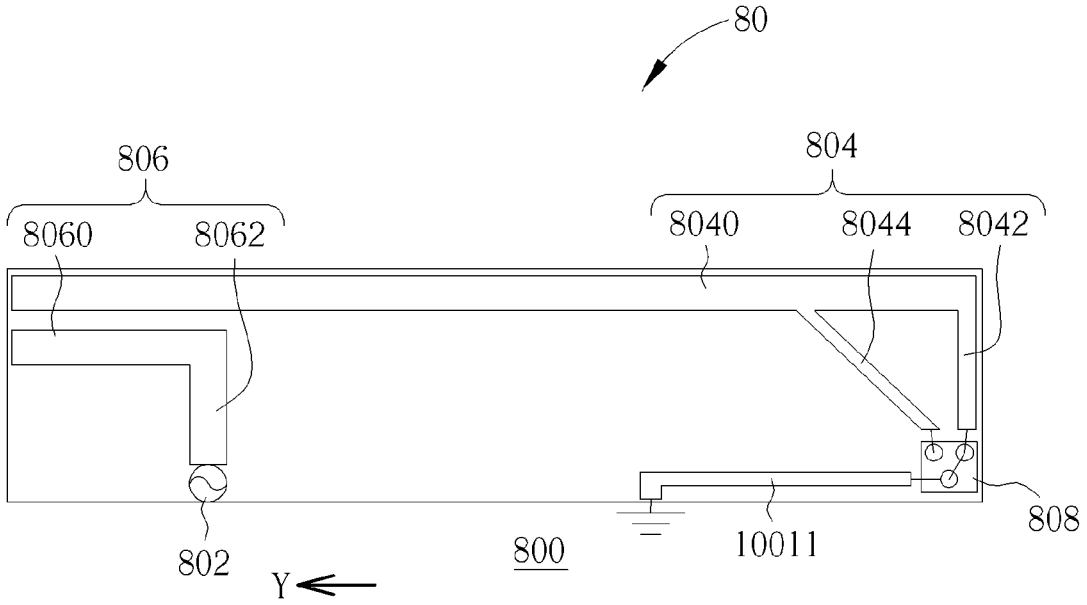
Figure 10E:
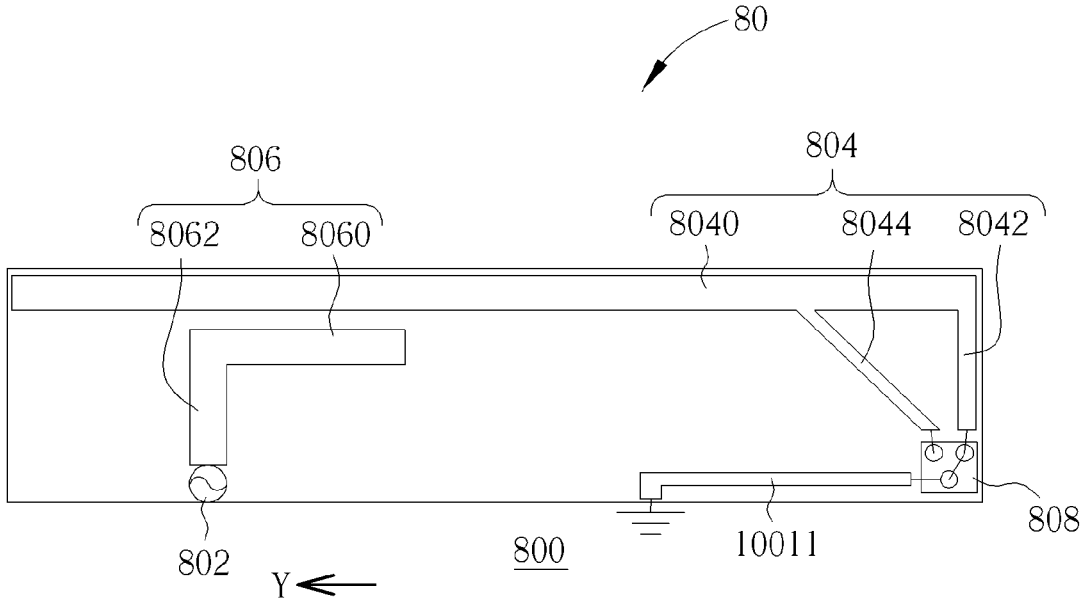

In addition, shapes of the coupling unit 806 and the radiation unit 804 are not limited. For example, please refer to FIG. 10A to 10E, which are schematic diagrams of the coupling unit 806 and the radiation unit 804 having different shapes. In FIG. 10A and FIG. 10B, the shape of the coupling unit 1006 is different from that of the coupling unit 806 shown in FIG. 8, wherein the coupling unit 1006 includes at least one bend for generating different coupling effect. In FIG. 10B and FIG. 10C, the long side 8040 includes at least one bend for increasing a length of a current route on the radiation unit 804, such that the tunable antenna 80 may operate in a lower radiation frequency band. A difference between FIG. 10C and FIG. 10D is that a bending side 10011 is disposed between the switch unit 808 and the ground element 800, which increases the length of the current route on the radiation unit 804 as well. A position that the vertical side 8062 electrically connected to the horizontal side 8060 may be adjusted, as long as a position of the signal feed-in terminal 802 is adjusted accordingly. For example, the vertical side 8062 shown in FIG. 10E is moved parallel to an end of the horizontal side 8060 along the direction Y. As a result, the tunable antenna 80 may have variable combinations of coupling relationships and different lengths of the current route, which broadens a design flexibility of the tunable antenna.

Figure 11A:
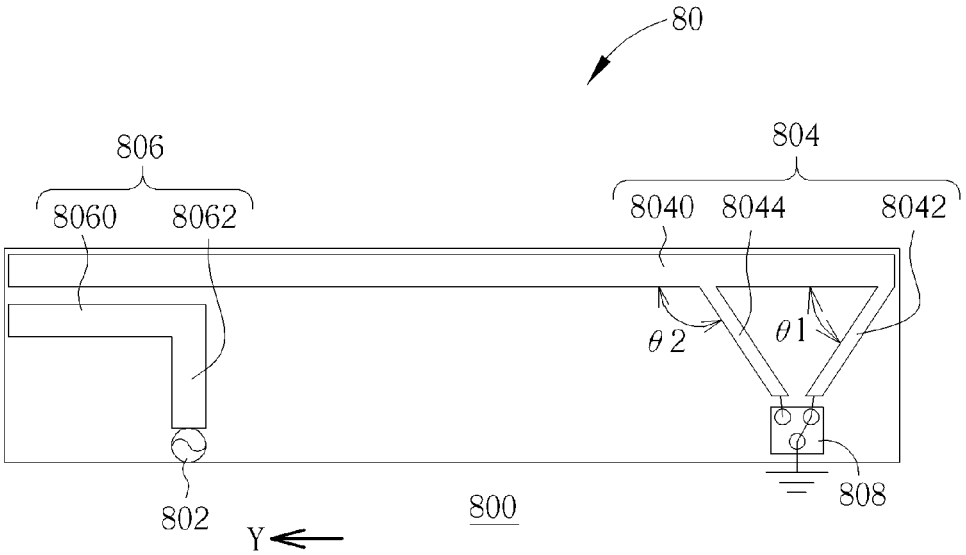
FIG. 11A and FIG. 11B are schematic diagrams of another tunable antenna according to embodiments of the present invention.
Figure 11B:
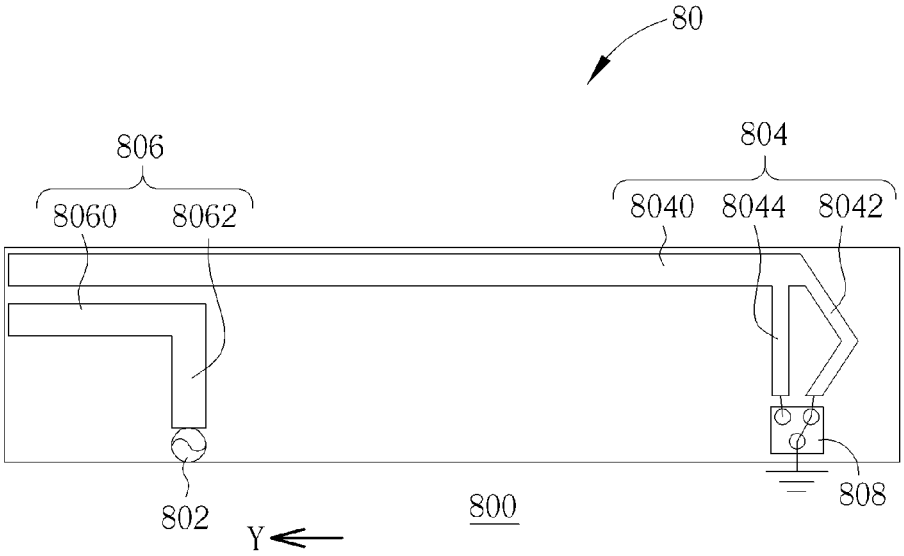

On the other hand, please refer to FIG. 11A and FIG. 11B, which illustrate the short sides 8042 and 8044 may electrically connect to the long side 8040 with any angles θ1 and θ2, wherein the angles θ1, θ2 are different. As shown in FIG. 11B, a bend may be added to the short sides 8042 and 8044, which is a method of adjusting a current route on the radiation unit 804.

Figure 12A:
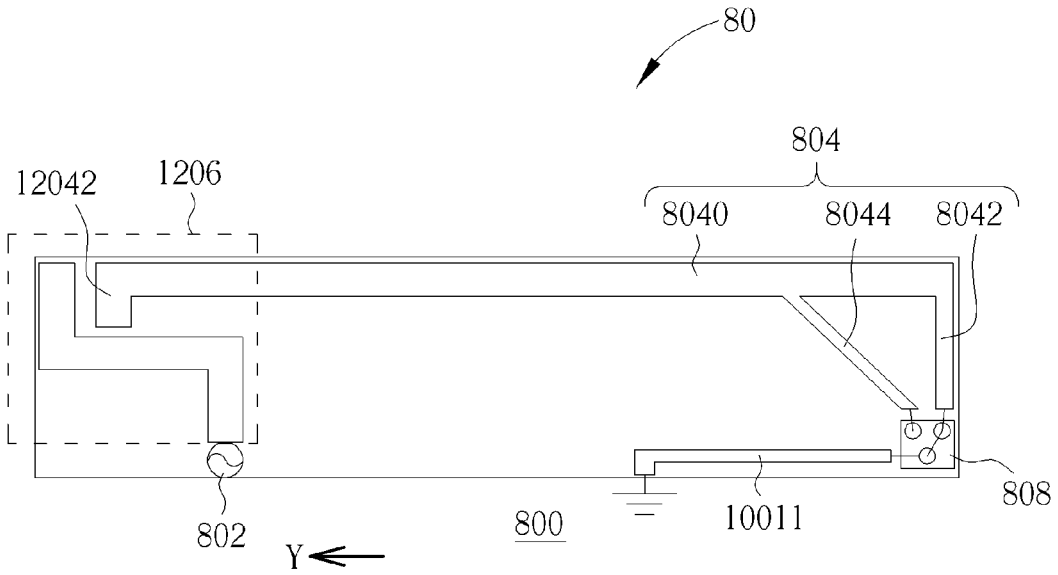
FIG. 12A and FIG. 12B are schematic diagrams of another tunable antenna according to embodiments of the present invention.
Figure 12B:
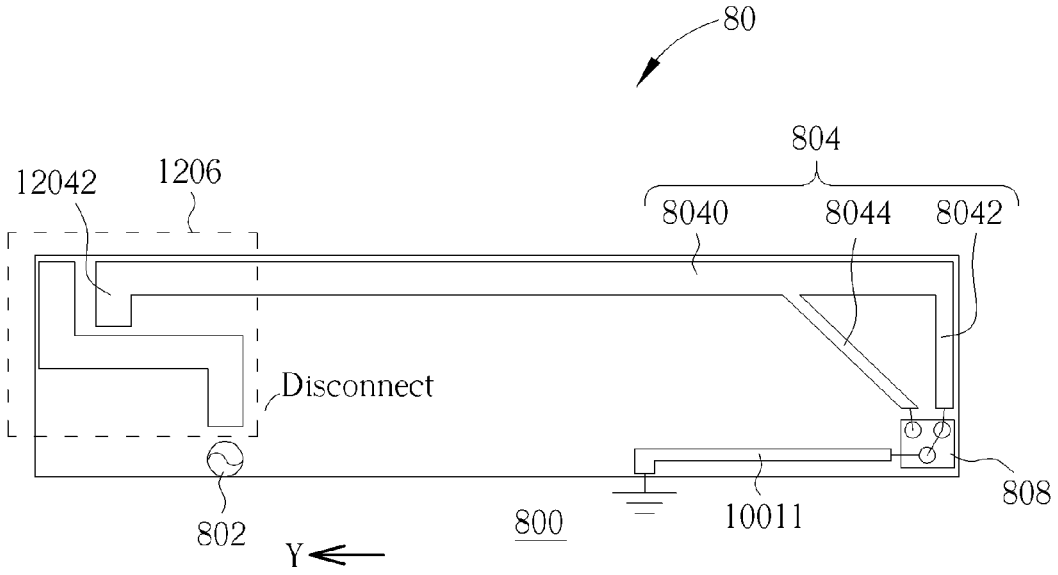

Please refer to FIG. 12A and FIG. 12B, which illustrate another bend 12042 added to the long side 8040, and a shape of the coupling unit 806 is changed. Since FIG. 12A, FIG. 12B and FIG. 8 are similar, same elements are denoted with same symbols. Noticeably, a difference between FIG. 12A and FIG. 12B is the coupling unit 1206 in FIG. 12B is coupling the feed-in of the RF signal instead of electrically connecting to the signal feed-in terminal 802, so as to provide another method to adjust the tunable antenna 80.

Figure 13A:
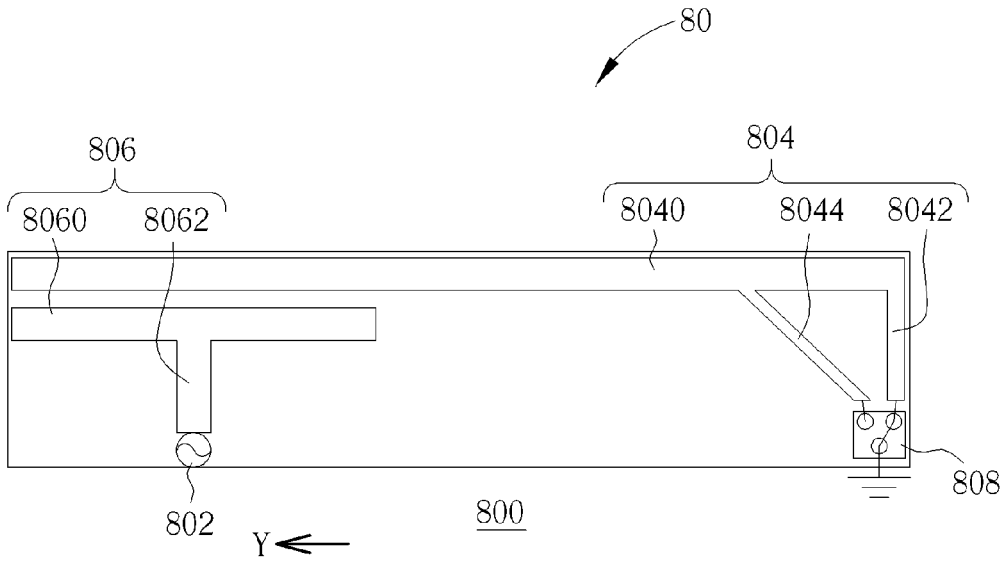
FIG. 13A and FIG. 13B are schematic diagrams of another tunable antennas according to embodiments of the present invention.
Figure 13B:
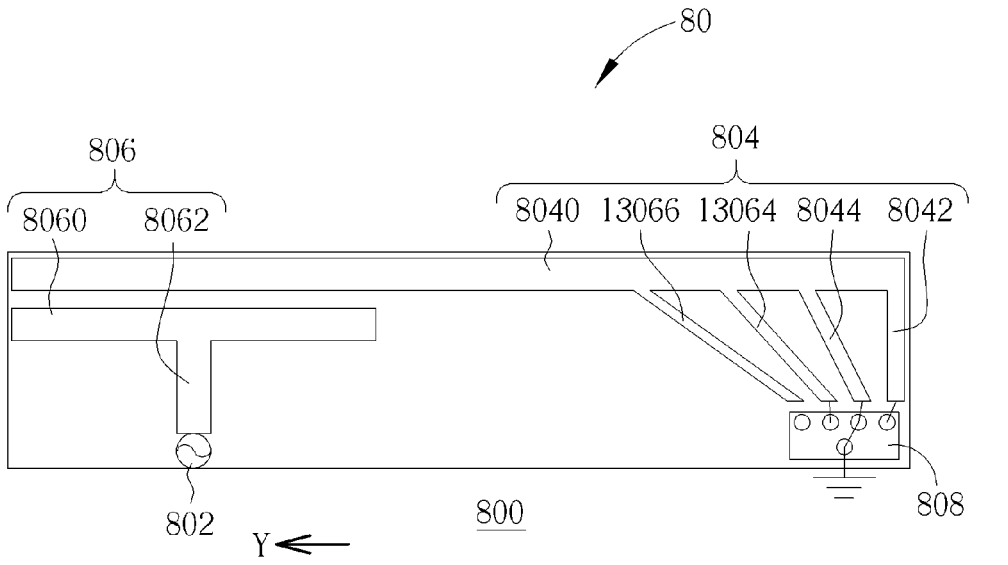

Please note that the present invention switches the connection between the short sides 8042, 8044 and the ground element 800 to change a length of the current route on the radiation unit 804, such that the radiation frequencies of the tunable antenna 80 are changed. Moreover, the present invention may further switch states A, B and more states to generate different frequency shift amounts on a single antenna. Please refer to FIG. 13A and FIG. 13B, which are schematic diagrams illustrating the coupling unit 806 having different shapes, and a position of the vertical side 8062 electrically connected to the horizontal side 8060 may be changed as long as a position of the signal feed-in terminal 802 is changed accordingly. As shown in FIG. 13B, short sides 13064 and 13066 are added into the radiation unit 804, such that the switch unit 808 may connect one of the short sides 8042, 8044, 13064 and 13066 to the ground element 800, to generate four distinct lengths of current routes on the radiation unit 804, which provides different amounts of frequency shift. In other words, by increasing a number of the short sides may generate multiple lengths of current routes on the radiation unit 804 to provide multiple switch states, such that tunable antenna 80 may operate in multiple radiation frequency bands.

As a result, the present invention may design different coupling units and radiation units, such as increasing bends on the coupling unit, increasing numbers of the short sides, changing a relative positions of the switch unit and the radiation unit, to generate different amounts of frequency shift, such that the tunable antenna may have a good design flexibility to meet different requirements of frequency bands within a limited antenna space.

To sum up, the traditional antenna designer often struggles for the tradeoff between antenna size and radiation bandwidth. In order to solve the problem, the present invention provides the tunable antenna with two different types corresponding to different methods of feeding the RF signal to the tunable antenna to adjust a current route or a coupling effect of the tunable antenna to change the radiation frequency of the tunable antenna. As a result, the tunable antenna may automatically adjust its radiation frequencies according to different wireless techniques to meet practical requirements and effectively broaden frequency bandwidth.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A tunable antenna comprising:
- a ground element for providing grounding;
- a signal feed-in terminal;
- a radiation unit electrically connected to the signal feed-in terminal and including a long side extended from the signal feed-in terminal along a first direction, a short side extended from the signal feed-in terminal along a second direction, and a branch electrically connected between the signal feed-in terminal and the ground element;
- a coupling unit for coupling to the long side, comprising:
  - a horizontal side substantially parallel to the long side; and
  - a plurality of vertical sides electrically connected and substantially perpendicular to the horizontal side; and
- a switch unit for connecting or disconnecting the coupling unit to or from the ground element to change a coupling relationship between the coupling unit and the long side, such that the tunable antenna respectively operates in a first frequency band and a second frequency band;
- wherein the switch unit connects one of the plurality of vertical sides to the ground element to generate different coupling relationships between the coupling unit and the long side.

2. The tunable antenna of claim 1, wherein the first direction is opposite to the second direction.

3. The tunable antenna of claim 1, wherein frequencies within the second frequency band are greater than frequencies within the first frequency band.

4. The tunable antenna of claim 1, wherein the long side and the short side further comprise at least one bend.

5. A radio-frequency (RF) device for a wireless communication device, the RF device comprising:
- a tunable antenna comprising:
  - a ground element for providing grounding;
  - a signal feed-in terminal;
  - a radiation unit electrically connected to the signal feed-in terminal and including a long side extended from the signal feed-in terminal toward a first direction, a short side extended from the signal feed-in terminal toward a second direction and a branch electrically connected between the signal feed-in terminal and the ground element;
  - a coupling unit for coupling to the long side, comprising:
    - a horizontal side substantially parallel to the long side; and
    - a plurality of vertical sides electrically connected and substantially perpendicular to the horizontal side; and
  - a switch unit for connecting or disconnecting the coupling unit and the ground element to change a coupling relationship between the coupling unit and the long side, wherein the switch unit connects one of the plurality of vertical sides to the ground element to generate different coupling relationships between the coupling unit and the long side;

an RF signal process module for processing an RF signal transmitted and received by the tunable antenna, and outputting a control signal according to the RF signal; and a control unit coupled between the RF signal process module and the switch unit for controlling the switch unit to adjust a connection between the coupling unit and the ground element according to the control signal, such that the tunable antenna respectively operates in a first frequency band and a second frequency band.

6. The RF device of claim 5, wherein the first direction is opposite to the second direction.

7. The RF device of claim 5, wherein frequencies within the second frequency band are greater than frequencies within the first frequency band.

8. The RF device of claim 5, wherein the long side and the short side further comprise at least one bend.

9. A tunable antenna comprising:

a ground element for providing grounding;

a signal feed-in terminal;

a coupling unit electrically connected to the signal feed-in terminal for feeding the tunable antenna through coupling;

a radiation unit comprising:

a long side extended along a first direction; and a plurality of short sides electrically connected to the long side and extended along a second direction; and a switch unit for switching one of the plurality of short sides to connect with the ground element to change a coupling current route on the radiation unit, such that the tunable antenna respectively operates in a first frequency band and a second frequency band.

10. The tunable antenna of claim 9, wherein the first direction is substantially perpendicular to the second direction.

11. The tunable antenna of claim 9, wherein frequencies within the second frequency band are greater than frequencies within the first frequency band.

12. The tunable antenna of claim 9, wherein the coupling unit comprises a horizontal side extended along the first direction, and a vertical side substantially parallel to the second direction and electrically connected between the horizontal side and the signal feed-in terminal for coupling the radiation unit.

13. The tunable antenna of claim 9, wherein the long side of the radiation unit and the horizontal side of the coupling unit further comprise at least one bend.

14. A radio-frequency (RF) device for a wireless communication device, the RF device comprising:

a tunable antenna comprising:

a ground element for providing grounding;

a signal feed-in terminal;

a coupling unit electrically connected to the signal feed-in terminal for feeding the tunable antenna through coupling;

a radiation unit comprising:

a long side extended along a first direction; and a plurality of short sides electrically connected to the long side and extended along a second direction; and a switch unit for switching one of the plurality of short sides to connect with the ground element to change a coupling current route on the radiation unit;

an RF signal process module for processing an RF signal transmitted and received by the tunable antenna, and outputting a control signal according to the RF signal; and a control unit coupled between the RF signal process module and the switch unit for controlling the switch unit according to the control signal to adjust the coupling current route on the radiation unit, such that the tunable antenna respectively operates in a first frequency band and a second frequency band.

15. The device of claim 14, wherein the first direction is substantially perpendicular to the second direction.

16. The device of claim 14, wherein frequencies within the second frequency band are greater than frequencies within the first frequency band.

17. The device of claim 14, wherein the coupling unit comprises a horizontal side extended along the first direction, and a vertical side substantially parallel to the second direction and electrically connected between the horizontal side and the signal feed-in terminal for coupling the radiation unit.

18. The device of claim 14, wherein the long side of the radiation unit and the horizontal side of the coupling unit further comprise at least one bend.

* * * * *